US007815053B2

(12) United States Patent
Knepp

(10) Patent No.: US 7,815,053 B2
(45) Date of Patent: Oct. 19, 2010

(54) WOVEN WIRE SCREENING AND A METHOD OF FORMING THE SAME

(75) Inventor: Boyd E. Knepp, Lancaster, PA (US)

(73) Assignee: Lumsden Corporation, Lancaster, PA (US)

( * ) Notice: Subject to any disclaimer, the term of this patent is extended or adjusted under 35 U.S.C. 154(b) by 272 days.

(21) Appl. No.: 12/155,152

(22) Filed: May 30, 2008

(65) Prior Publication Data

US 2009/0294334 A1 Dec. 3, 2009

(51) Int. Cl.
*B07B 1/46* (2006.01)

(52) U.S. Cl. ..... 209/400; 209/401

(58) Field of Classification Search ..... 209/400, 209/401; 210/499

See application file for complete search history.

(56) References Cited

U.S. PATENT DOCUMENTS

| | | | | |
|---|---|---|---|---|
| 297,729 | A | 4/1884 | Thompson | |
| 1,139,468 | A | 5/1915 | Potter | |
| 1,678,362 | A | 7/1928 | Sloan | |
| 1,814,598 | A | 7/1931 | Herrmann | |
| 1,997,713 | A | 4/1935 | Boehm | |
| 2,194,222 | A | 3/1940 | Ewing | |
| 3,266,130 | A * | 8/1966 | Glaze | 228/182 |
| 3,473,576 | A * | 10/1969 | Amneus | 139/420 R |
| 3,485,706 | A * | 12/1969 | Evans | 428/134 |
| 3,716,138 | A | 2/1973 | Lumsden | |
| 4,024,612 | A * | 5/1977 | Contractor et al. | 28/105 |
| 4,491,517 | A | 1/1985 | Janovac | |
| 6,305,432 | B1 * | 10/2001 | Sacks et al. | 139/425 R |
| 6,457,588 | B1 * | 10/2002 | Schulte et al. | 210/388 |
| 7,370,766 | B2 * | 5/2008 | Perala | 210/490 |

FOREIGN PATENT DOCUMENTS

| | | | |
|---|---|---|---|
| JP | 03227806 A | * | 10/1991 |
| WO | WO 98/47633 | | 10/1998 |

* cited by examiner

*Primary Examiner*—Joseph C Rodriguez
(74) *Attorney, Agent, or Firm*—Merek, Blackmon & Voorhees, LLC

(57) ABSTRACT

A woven wire screening for use in classifying material flowing therethrough and a method of forming the same. The woven wire screening includes a plurality of warp wires and a plurality of weft wires. The plurality of warp wires and the plurality of weft wires are interwoven to form an integral wire cloth having a plurality of openings for permitting material to be classified to flow through the openings. The plurality of warp wires are crimped to form upper and lower knuckles. The plurality of weft wires are crimped to form upper and lower knuckles. Preferably, the plurality of weft wires are crimped deeper than the plurality of warp wires such that the upper knuckles of the weft wires are higher than the upper knuckles of the warp wires creating a knuckle height differential between the upper knuckles of the weft wires and the upper knuckles of the warp wires. The woven wire cloth is formed such that a ratio of the knuckle height differential and size of at least one of the plurality of openings ranges from 5% to 35%. Preferably, the plurality of weft wires have a cross-sectional height at least four wires sizes greater than its cross-sectional width. Similarly, it is preferred that the plurality of warp wires have a cross-sectional height at least four wires sizes greater than its cross-sectional width. The warp and weft wires may each be provided with a pair of substantially flat sidewalls.

20 Claims, 4 Drawing Sheets

WOVEN WIRE SCREENING AND A METHOD OF FORMING THE SAME

FIELD OF THE INVENTION

The present invention is directed to a woven wire screening and a method of forming the same. More particularly, a preferred embodiment of the present invention is directed to a woven wire screening used in a shaker or vibrating screen apparatus that classifies material flowing through one or more woven wire screenings.

BACKGROUND OF THE INVENTION

One or more woven wire screens have been used in shaker or vibrating screen apparatus to size material passing through the woven wire screens. Known woven wire screens typically consist of a plurality of interwoven weft and warp wires forming a plurality of openings for permitting suitably sized material to pass through the screen. The openings can be square or rectangular. Alternatively, the screen can be formed as a long slot screen where the warp wires are maintained in spaced parallel relation by weft wires arranged in groups of three at spaced intervals along the length of the warp wires.

Previously known woven wire screens suffer from significant drawbacks. For example, known woven wire screens have experienced rolling of one or more wires. The problem of rolling is depicted in FIG. 1. Specifically, weft wires 2, 4, 6, 8 and 10 of woven wire cloth A have been undesirably rolled during the manufacturing process. This is problematic in that the size of the openings surrounded by one or more rolled wires is significantly different from the size of openings surrounded by non-rolled wires. This is readily evident from a comparison of opening 12 bound on opposite sides by two rolled weft wires 2 and 4 with opening 14 bound on all four sides by non-rolled wires. To properly size product or material, it is imperative to have openings in woven wire screens that conform precisely to predetermined sizes. Any variance in the size of the openings due to the manufacturing process can significantly degrade the performance of the woven wire screen. It should be noted that the amount of roll will vary further degrading the performance of the woven wire screen.

Rolling of a wire results from exceeding the yield point of the wire during assembly of the woven wire screen. Conventional thinking has been along the lines that forming woven wire screens with shallow crimps (i.e., higher knuckle forces and higher preloads) improves the longevity of the woven wire screen. However, rolling can occur especially if the configuration of the wire is modified to improve the through put of the woven wire screen. This is due at least in part to the fact that shallow crimps require less side forces to displace the corresponding wire.

Conventional woven wire screens have also been unable to achieve significant additional through put by providing additional open area. Specifically, increasing the open area of a screen has previously resulted in additional through put that is approximately equal to the increase in the open area. For example, if the open area is increased by 3% then the additional through put previously achieved would be approximately 3%. This is undesirable as the efficiency of conventional screens is limited in that the percentage of additional through put is limited to approximately the same percentage of the additional open area. Moreover, the configuration of conventional wires can cause the product to deflect upwardly even though the product is suitably sized to pass through the screen. This is particularly prevalent with screens having round wires. Further, previously known screens with wires having a cross-sectional height greater than the cross-sectional width have experienced some upward movement because the difference between the cross-sectional height and the cross-sectional width has not been great enough to eliminate or dramatically reduce upward movement of particles. This is undesirable as it can significantly reduce the efficiency of the woven wire screen.

OBJECTS AND SUMMARY OF THE INVENTION

An object of the present invention is to provide a novel and unobvious woven wire screening and method of forming the same.

Another object of a preferred embodiment of the present invention is to provide a woven wire screen that has a significant height differential between the knuckles of the weft wires and the knuckles of the warp wires to increase the through put of the screen.

A further object of a preferred embodiment of the present invention is to provide a woven wire screening with weft wires and warp wires having substantially flat sidewalls to deflect product to be sized downward through the screen.

Yet another object of a preferred embodiment of the present invention is to provide a woven wire screening with weft wires having a greater crimp depth than the warp wires to channel the product to be sized through the screen.

Still another object of a preferred embodiment of the present invention is to provide a woven wire screening that is formed such that the ratio of the height differential between the weft and warp knuckles and the width of the openings in the screen range from 5% to 35% to prevent rolling of either the weft wires or warp wires and improve the through put of the screen.

Yet still another object of a preferred embodiment of the present invention is to provide a woven wire screening that an be readily formed without rolling of the weft or warp wires.

A further object of a preferred embodiment of the present invention is to provide a woven wire screening with warp and weft wires that have a height at least four wire sizes greater than their width.

It must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

In summary, a preferred embodiment of the present invention is directed to a woven wire screening for use in classifying material flowing through the woven wire screening. The woven wire screening includes a plurality of warp wires and a plurality of weft wires. The plurality of warp and the plurality of weft wires are interwoven to form an integral wire cloth having a plurality of openings for permitting material to be classified to flow through the openings. The plurality of warp wires are crimped to form upper and lower knuckles. The plurality of weft wires are crimped to form upper and lower knuckles. The plurality of weft wires are crimped deeper than the plurality of warp wires such that the upper knuckles of the weft wires are higher than the upper knuckles of the warp wires creating a knuckle height differential between the upper knuckles of the weft wires and the upper knuckles of the warp wires. The woven wire cloth is formed such that a ratio of the knuckle height differential and size of at least one of the plurality of openings equals a predetermined value.

Another preferred embodiment of the present invention is directed to a woven wire screening for use in classifying material flowing through the woven wire screening. The woven wire screening includes a plurality of warp wires and a plurality of weft wires. The plurality of warp wires and the plurality of weft wires are interwoven to form an integral wire cloth having a plurality of openings formed therein for permitting material to be classified to flow through the openings. The plurality of warp wires are crimped to form upper and lower knuckles. The plurality of weft wires are crimped to form upper and lower knuckles. The plurality of weft wires have a cross-sectional height at least four wires sizes greater than its cross-sectional width. The plurality of warp wires have a cross-sectional height at least four wires sizes greater than its cross-sectional width.

A further preferred embodiment of the present invention is directed to a method of forming a woven wire screening used in classifying material flowing through the woven wire screening. The method includes the steps of: (a) providing a plurality of warp wires; (b) providing a plurality of weft wires; (c) crimping the plurality of warp wires to form upper and lower knuckles; (d) crimping the plurality of weft wires deeper than the plurality of warp wires to create a knuckle height differential between upper knuckles of the weft wires and the upper knuckles of the warp wires; (e) interweaving the plurality of warp and the plurality of weft wires to form an integral wire cloth having a plurality of openings for permitting material to be classified to flow through the openings; and, (f) forming the integral woven wire cloth such that a ratio of the knuckle height differential and width of at least one of the plurality of openings ranges from 5% to 35%.

DETAILED DESCRIPTION OF THE PREFERRED EMBODIMENTS OF THE INVENTION

The preferred forms of the invention will now be described with reference to FIGS. 2-6. The appended claims are not limited to the preferred forms and no term and/or phrase used herein is to be given a meaning other than its ordinary meaning unless it is expressly stated that the term and/or phrase shall have a special meaning.

FIGS. 2-6

Referring to FIGS. 2 to 6, a woven wire screening or screen B formed in accordance with a preferred embodiment of the present invention is illustrated in one of many possible configurations. Screen B includes a plurality of interwoven warp wires 16 and weft wires 18. Screen B includes a plurality of openings 20 of a predetermined size. While openings 20 are illustrated as being substantially square, it will be readily appreciated that the openings may be of any suitable configuration including but not limited to rectangular. Further, screen B can be formed as a long slot screen where the warp wires are maintained in spaced parallel relation by weft wires arranged in groups of three at spaced intervals along the length of the warp wires. The warp wires 16 and weft wires 18 can be formed of any suitable material.

Figure 1:
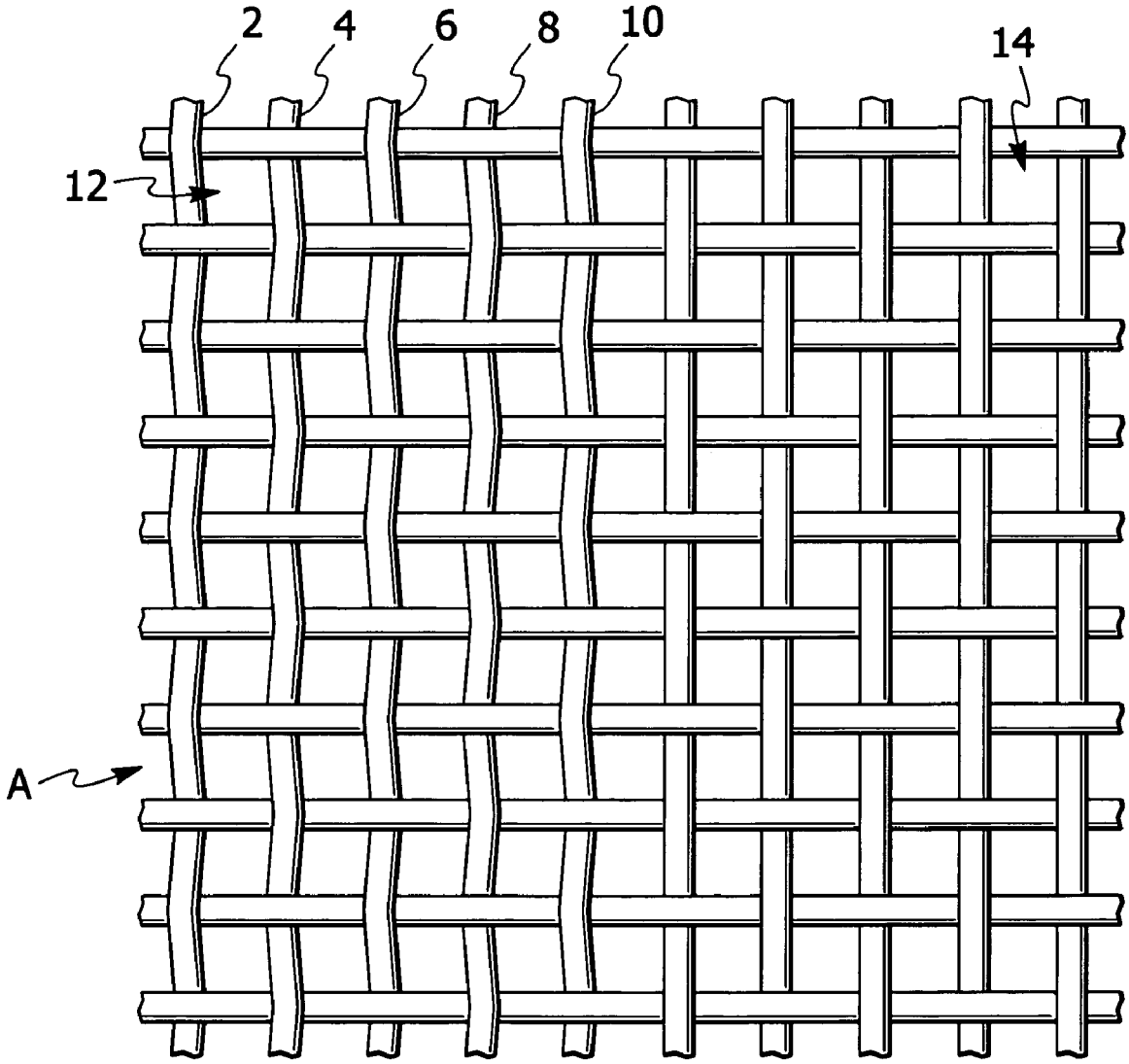
FIG. 1 (Prior Art)
FIG. 1 is a plan view of a portion of a woven wire screening illustrating the problem of rolled wires.
Figure 2:
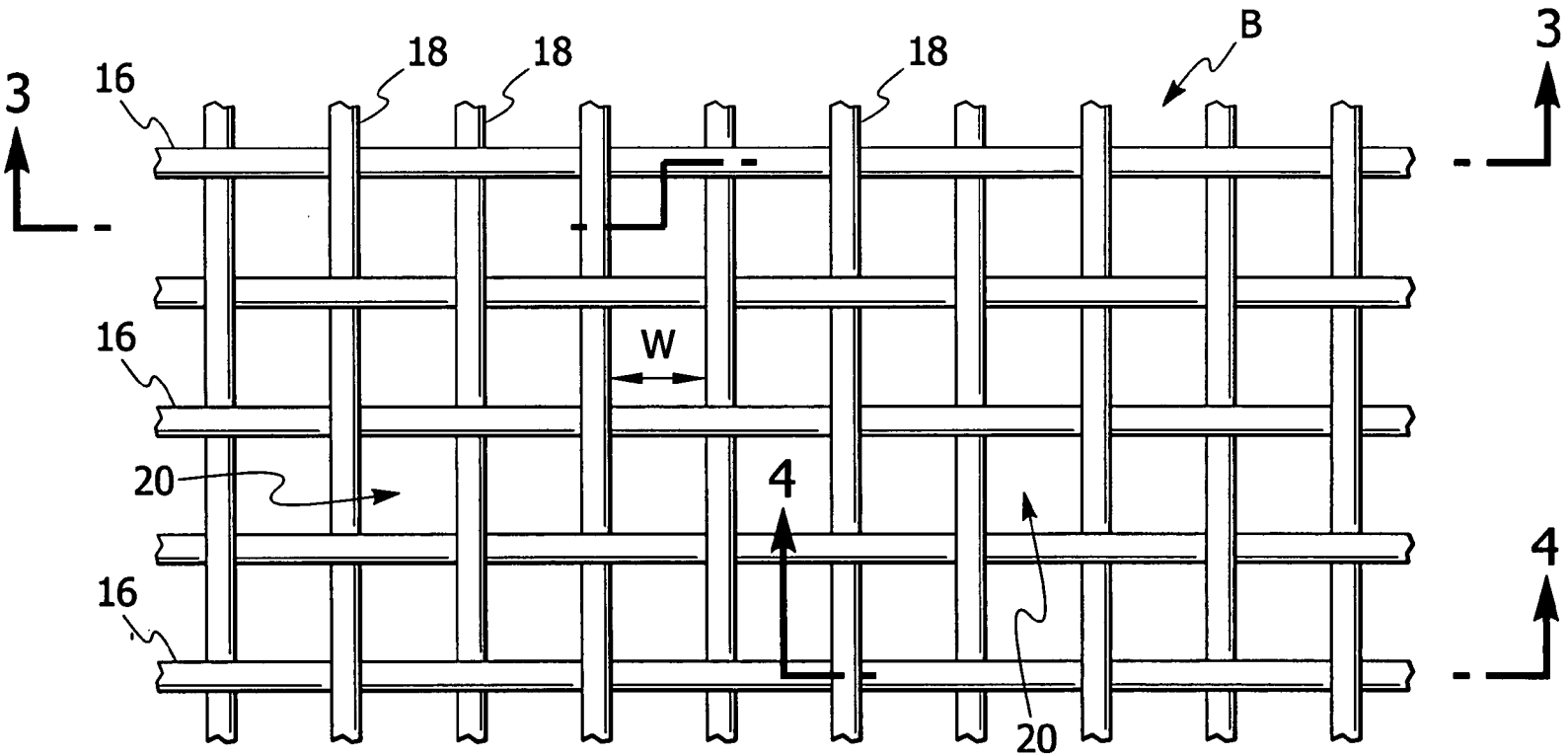
FIG. 2 is a plan view of a portion of a woven wire screening formed in accordance with a preferred embodiment of the present invention.
Figure 3:
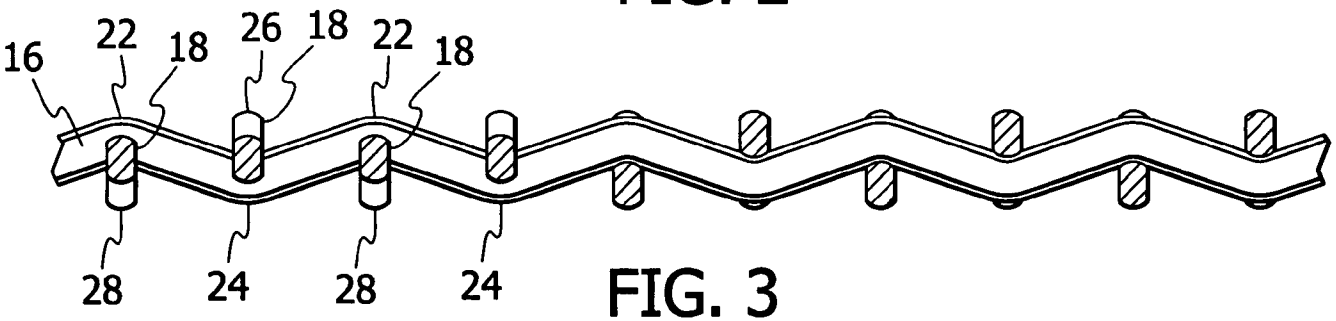
FIG. 3 is a fragmentary cross-sectional view taken along lines 3-3 illustrated in FIG. 2.
Figure 4:
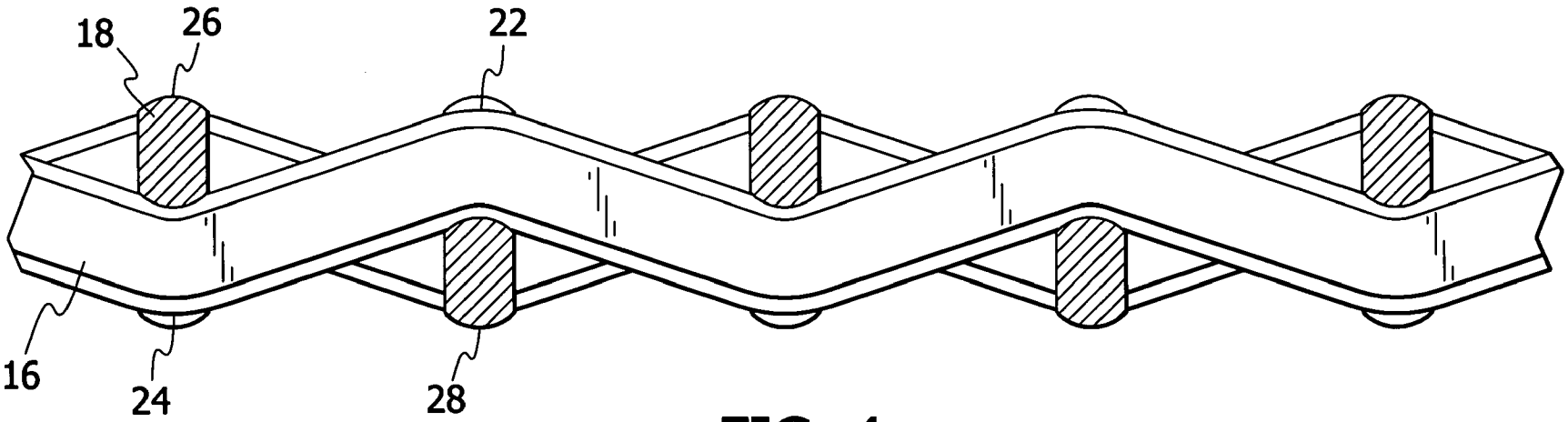
FIG. 4 is an enlarged fragmentary cross-sectional view taken along lines 4-4 in FIG. 2.

Referring to FIGS. 3 and 4, the warp wires 16 are crimped to form a series of upwardly projecting upper knuckles 22 and a series of downwardly projecting lower knuckles 24 along the length of the warp wires 16. The weft wires 18 are crimped to form a series of upwardly projecting upper knuckles 26 and a series of downwardly projecting lower knuckles 28 along the length of the weft wires 18. The upper knuckles 26 of the weft wires 18 are nested in the corresponding lower knuckles 24 of warp wires 16. Similarly, the lower knuckles 28 of the weft wires 18 are nested in the corresponding upper knuckles 22 of the warp wires 16.

Figure 5:
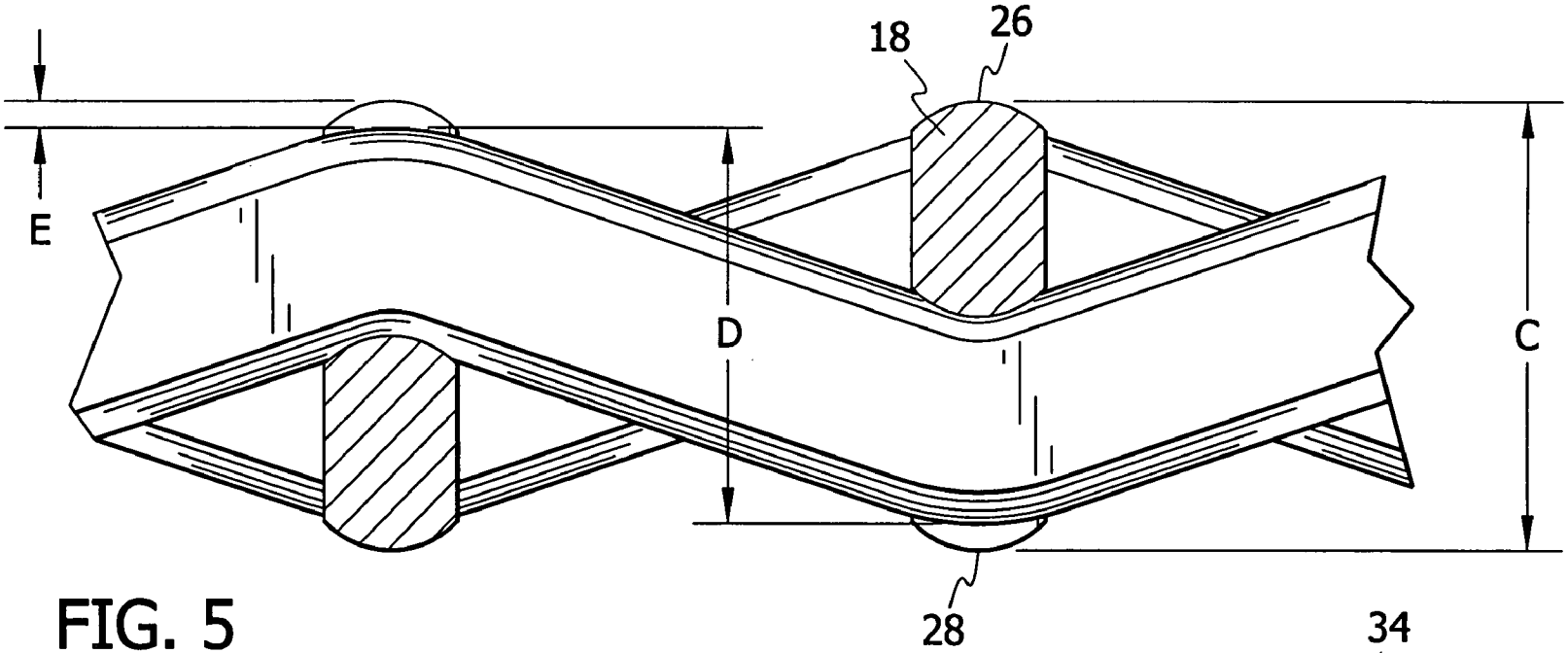
FIG. 5 is an enlarged cross-sectional view of a portion of a woven wire screening depicting the crimp depth of the weft wires, the crimp depth of the warp wires and the knuckle height differential between an upper knuckle of a weft wire and an upper knuckle of a warp wire.

Referring to FIG. 5, the overall height C of the weft wires 18 (i.e., the distance between the upper knuckle 26 and the lower knuckle 28 of the weft wires 18) is greater than the overall height D (i.e., the distance between the upper knuckle 22 and the lower knuckle 24 of the warp wires 16) creating a height differential E between upper knuckles 26 of weft wires 18 and upper knuckles 22 of warp wires 16. It should be noted that E is one half the difference between the overall height C and the overall height D. Screen B is preferably formed such that the ratio of E/W ranges from 5% to 35% where W is the width of the opening 20. For example, screen B can be configured such that C is 0.361 inches and D 0.264 inches such that E is 0.0485 inches. Providing openings 20 with a W of 0.375 inches yields a E/W ratio of approximately 12.9%. Forming screen B in this manner has significant advantages. First, the through put is increased dramatically. This is believed to be due in part to the channeling effect of the deeper crimped weft wires 18. Also, this configuration of screen B allows for "secondary screening." Specifically, the ratio of E/W ranging from 5% to 35% causes the upper knuckles 26 of the weft wires 18 to hold larger size particles on screen B a sufficient distance away from the upper knuckles 22 of the warp wires 16 allowing smaller size particles to pass through screen B. Further, the deeper crimp of the weft wires 18 prevents rolling during assembly.

Figure 6:
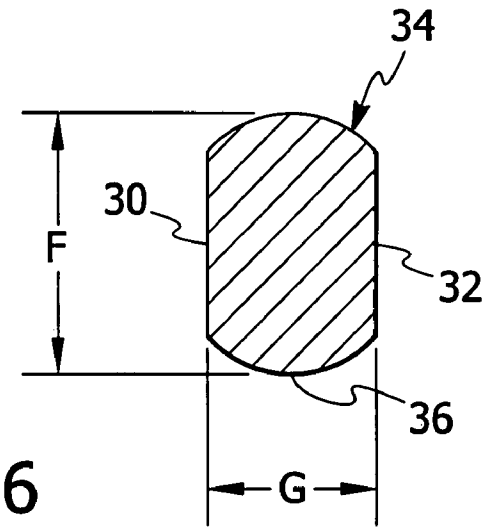
FIG. 6 is an enlarged cross-sectional view depicting the configuration of the weft and warp wires formed in accordance with a preferred embodiment of the present invention.

Referring to FIG. 6, the warp wires 16 and weft wires 18 preferably have a cross-sectional height F that is significantly greater than the cross-sectional width G. Most preferably, F is more than four standard wire sizes greater than G. The standard wire sizes are as follows: 1.000"; 0.750"; 0.625"; 0.500"; 0.4375"; 0.375"; 0.3125"; 0.250"; 0.225"; 0.207"; 0.192"; 0.177"; 0.162"; 0.148"; 0.135"; 0.120"; 0.105"; 0.092"; 0.080"; 0.072"; 0.063"; 0.054"; 0.047"; 0.041"; 0.035"; and 0.032". For example warp wires 16 and weft wires 18 can be formed such that G is 0.110" and F is 0.167" such that F is more than four standard wire sizes greater than G. Warp wires 16 and weft wires 18 each preferably have substantially flat sidewalls 30 and 32. Further, warp wires 16 and weft wires 18 each preferably have arcuate upper and lower surfaces 34 and 36, respectively extending between sidewalls 30 and 32. Forming the warp and weft wires with a cross-sectional configuration as described above ensures that suitably sized particles impacting screen B will be directed downwardly through screen B as opposed to upwardly and away from the openings in screen B improving the efficiency of screen B.

While this invention has been described as having a preferred design, it is understood that the preferred design can be further modified or adapted following in general the principles of the invention and including but not limited to such departures from the present invention as come within the known or customary practice in the art to which the invention pertains. The claims are not limited to the preferred embodiment and have been written to preclude such a narrow construction using the principles of claim differentiation.

I claim:

1. A woven wire screening for use in classifying material flowing through said woven wire screening; said woven wire screening comprising:

(a) a plurality of warp wires, each of said plurality of warp wires having two substantially flat sidewall portions;

(b) a plurality of weft wires, each of said plurality of weft wires having two substantially flat sidewall portions, said plurality of warp and said plurality of weft wires being interwoven to form an integral wire cloth having a plurality of openings for permitting material to be classified to flow through said openings;

(c) said plurality of warp wires being crimped to form upper and lower knuckles, said plurality of weft wires being crimped to form upper and lower knuckles, said plurality of weft wires being crimped deeper than said plurality of warp wires such that said upper knuckles of said weft wires are higher than said upper knuckles of said warp wires creating a knuckle height differential between said upper knuckles of said weft wires and said upper knuckles of said warp wires; and, (d) said woven wire cloth being formed such that a ratio of said knuckle height differential and width of at least one of said plurality of openings ranges from 5% to 35%.

2. The woven wire screening as set forth in claim 1, wherein:

(a) said woven wire cloth is formed such that a ratio of said knuckle height differential and a width of at least one of said plurality of openings is approximately 12.9%.

3. The woven wire screening as set forth in claim 1, wherein:

(a) said woven wire cloth is formed such that a ratio of said knuckle height differential and a width of at least one of said plurality of openings ranges from 8% to 35%.

4. The woven wire screening as set forth in claim 1, wherein:

(a) said woven wire cloth is formed such that a ratio of said knuckle height differential and a width of at least one of said plurality of openings ranges from 10% to 35%.

5. The woven wire screening as set forth in claim 1, wherein:

(a) said plurality of openings have a substantially uniform size and shape.

6. The woven wire screening as set forth in claim 1, wherein:

(a) said plurality of openings have a substantially square configuration.

7. The woven wire screening as set forth in claim 1, wherein:

(a) said plurality of weft wires have a cross-sectional height more than four wires sizes greater than its cross-sectional width.

8. The woven wire screening as set forth in claim 7, wherein:

(a) said plurality of warp wires have a cross-sectional height more than four wires sizes greater than its cross-sectional width.

9. A woven wire screening for use in classifying material flowing through said woven wire screening; said woven wire screening comprising:

(a) a plurality of warp wires, each of said plurality of warp wires having two substantially flat sidewall portions;

(b) a plurality of weft wires, each of said plurality of weft wires having two substantially flat sidewall portions, said plurality of warp wires and said plurality of weft wires being interwoven to form an integral wire cloth having a plurality of openings formed therein for permitting material to be classified to flow through said openings;

(c) said plurality of warp wires being crimped to form upper and lower knuckles, said plurality of weft wires being crimped to form upper and lower knuckles;

(d) said plurality of weft wires having a cross-sectional height more than four wires sizes greater than its cross-sectional width; and, (e) said plurality of warp wires having a cross-sectional height more than four wires sizes greater than its cross-sectional width.

10. The woven wire screening as set forth in claim 9, wherein:

(a) said plurality of weft wires being crimped deeper than said plurality of warp wires such that said upper knuckles of said weft wires are higher than said upper knuckles of said warp wires creating a knuckle height differential between said upper knuckles of said weft wires and said upper knuckles of said warp wires, said woven wire cloth being formed such that a ratio of said knuckle height differential and size of at least one of said plurality of openings ranges from 5% to 35%.

11. The woven wire screening as set forth in claim 10, wherein:

(a) said plurality of weft wires each have an upper arcuate surface and lower arcuate surface extending between said two flat sidewalls.

12. The woven wire screening as set forth in claim 11, wherein:

(a) said plurality of warp wires and said plurality of weft wires being substantially the same size.

13. The woven wire screening as set forth in claim 12, wherein:

(a) said plurality of warp wires each have an upper arcuate surface and lower arcuate surface extending between said two flat sidewalls.

14. A method of forming a woven wire screening used in classifying material flowing through the woven wire screening; said method including the steps of:

(a) providing a plurality of warp wires, each of said plurality of warp wires having two substantially flat sidewall portions;

(b) providing a plurality of weft wires, each of said plurality of weft wires having two substantially flat sidewall portions, said plurality of warp wires and said plurality of weft wires being substantially the same size;

(c) crimping the plurality of warp wires to form upper and lower knuckles;

(d) crimping the plurality of weft wires deeper than the plurality of warp wires to create a knuckle height differential between upper knuckles of the weft wires and the upper knuckles of the warp wires;

(e) interweaving the plurality of warp and the plurality of weft wires to form an integral wire cloth having a plurality of openings for permitting material to be classified to flow through the openings; and (f) forming the integral woven wire cloth such that a ratio of the knuckle height differential and width of at least one of the plurality of openings ranges from 5% to 35%.

15. The method as recited in claim 14, including the further step of:

(a) forming the integral woven wire cloth such that a ratio of the knuckle height differential and width of at least one of the plurality of openings ranges from 8% to 35%.

16. The method as recited in claim 14, including the further step of:

(a) forming the integral woven wire cloth such that a ratio of the knuckle height differential and width of at least one of the plurality of openings ranges from 10% to 25%.

17. The method as recited in claim 14, including the further step of:

(a) forming the integral woven wire cloth such that a ratio of the knuckle height differential and width of at least one of the plurality of openings ranges from 10% to 15%.

18. The method as recited in claim 14, including the further step of:

(a) forming each of the plurality of weft wires such that its cross-sectional height is more than four wires sizes greater than its cross-sectional width.

19. The method as recited in claim 18, including the further step of:

(a) forming each of the plurality of warp wires such that its cross-sectional height is more than four wires sizes greater than its cross-sectional width.

20. The method as recited in claim 19, including the further step of:

(a) providing each of said plurality of weft wires and each of said plurality of warp wires with an upper arcuate surface and a lower arcuate surface extending between said two flat sidewalls.

* * * * *